US005445129A

United States Patent [19]

Barnes

[11] Patent Number: 5,445,129

[45] Date of Patent: Aug. 29, 1995

[54] METHOD FOR CONTROLLING A HYDRAULICALLY-ACTUATED FUEL INJECTION SYSTEM

[75] Inventor: Travis E. Barnes, Peoria, Ill.

[73] Assignee: Caterpillar Inc., Peoria, Ill.

[21] Appl. No.: 282,834

[22] Filed: Jul. 29, 1994

[51] Int. Cl.[6] ..... F02M 37/04

[52] U.S. Cl. ..... 123/446; 123/496; 123/381; 123/179.17

[58] Field of Search ..... 123/446, 179.17, 381, 123/496, 501

[56] References Cited

U.S. PATENT DOCUMENTS

| | | | |
|---|---|---|---|
| Re. 33,270 | 7/1990 | Beck et al. | 123/447 |
| 4,368,705 | 1/1983 | Stevenson et al. | 123/357 |
| 4,870,939 | 10/1989 | Ishikawa et al. | 123/506 |
| 5,024,200 | 6/1991 | Free et al. | 123/501 |
| 5,056,488 | 10/1991 | Eckert | 123/496 |
| 5,094,215 | 3/1992 | Gustafson | 123/496 |
| 5,094,216 | 3/1992 | Miyaki | 123/496 |
| 5,143,291 | 9/1992 | Grinsteiner | 239/88 |
| 5,152,266 | 10/1992 | Sekiguchi et al. | 123/357 |
| 5,156,132 | 10/1992 | Iwanaga | 123/496 |
| 5,168,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,213,083 | 5/1993 | Glassey | 123/179.17 |
| 5,245,970 | 9/1993 | Iwasszkiewicz et al. | 123/447 |
| 5,313,924 | 5/1994 | Regueiro | 123/456 |
| 5,357,912 | 10/1994 | Barnes | 123/446 |
| 5,375,576 | 12/1994 | Ausman | 123/446 |

FOREIGN PATENT DOCUMENTS 0149598 7/1985 European Pat. Off. .

OTHER PUBLICATIONS

SAE Paper No. 930270, "HEUI—A New Direction for Diesel Engine Fuel Systems", Glassey et al., International Congress and Exposition, Dertoit, Mich., Mar. 1-5, 1993.

SAE Paper No. 930271, "Development of the HEUI Fuel System—Integration of Design, Simulation, Test, and Manufacturing", Stockner et al., International Congress and Exposition, Detroit, Mich., Mar. 1-5, 1993.

SAE Paper No. 940586, "Benefits of New Fuel Injection System Technology on Cold Startability of Diesel Engines—Improvement of Cold Startability of Diesel White Smoke Reduction by Means of Multi Injection with Common Rail Fuel System (ECD-U2)", Osuka et al., International Congress and Exposition, Detroit, Mich., Feb. 28-Mar. 3, 1994.

*Primary Examiner*—Carl S. Miller

*Attorney, Agent, or Firm*—David M. Masterson

[57] ABSTRACT

In one aspect of the present invention, a method is disclosed that controls the actuating fluid pressure supplied to a hydraulically-actuated injector and the time duration over which the hydraulically-actuated injector injects fuel. The desired actuating fluid pressure and injection duration is swept across a range of values to achieve an optimum combination of values to start an engine.

4 Claims, 5 Drawing Sheets

METHOD FOR CONTROLLING A HYDRAULICALLY-ACTUATED FUEL INJECTION SYSTEM

TECHNICAL FIELD

The present invention relates generally to hydraulically-actuated fuel injection systems and, more particularly to electronic control systems for independently controlling the fuel injection rate and duration to start an engine.

BACKGROUND ART

A diesel engine achieves combustion by injecting fuel that vaporizes into the hot air of an engine cylinder. However, during cold starting conditions, the air loses much of its heat to the cylinder walls making engine starting difficult. For example, if too much fuel is injected into the cylinder, the heat required to vaporize the cold fuel reduces the air temperature about the injection point and may prevent or quench combustion. Thus, it is desirable to inject fuel slowly to disperse the fuel throughout the combustion chamber to evenly distribute the resulting heat losses in order to cause combustion.

The injection rate of hydraulically-actuated fuel injector systems, similar to those described in U.S. Pat. Nos. 5,191,867 and 5,181,494, is controlled by the actuating fluid pressure and viscosity. However, the fluid viscosity changes in response to fluid temperature and fluid grades. Although it is possible to control the actuating fluid pressure as a function of fluid temperature for a single fluid grade, it becomes increasingly difficult to control the actuating fluid pressure to start an engine where the fluid grade is unknown.

The present invention is directed to overcoming one or more of the problems as set forth above.

DISCLOSURE OF THE INVENTION

In one aspect of the present invention, a method is disclosed that controls the actuating fluid pressure supplied to a hydraulically-actuated injector and the time duration over which the hydraulically-actuated injector injects fuel. The desired actuating fluid pressure and injection duration is swept across a range of values to achieve an optimum combination of values to start an engine.

BEST MODE FOR CARRYING OUT THE INVENTION

The present invention relates to an electronic control system for use in connection with a hydraulically actuated electronically controlled unit injector fuel system. Hydraulically actuated electronically controlled unit injector fuel systems are known in the art. One example of such a system is shown in U.S. Pat. No. 5,191,867, issued to Glassey on Mar. 9, 1993, the disclosure of which is incorporated herein by reference.

Figure 1:
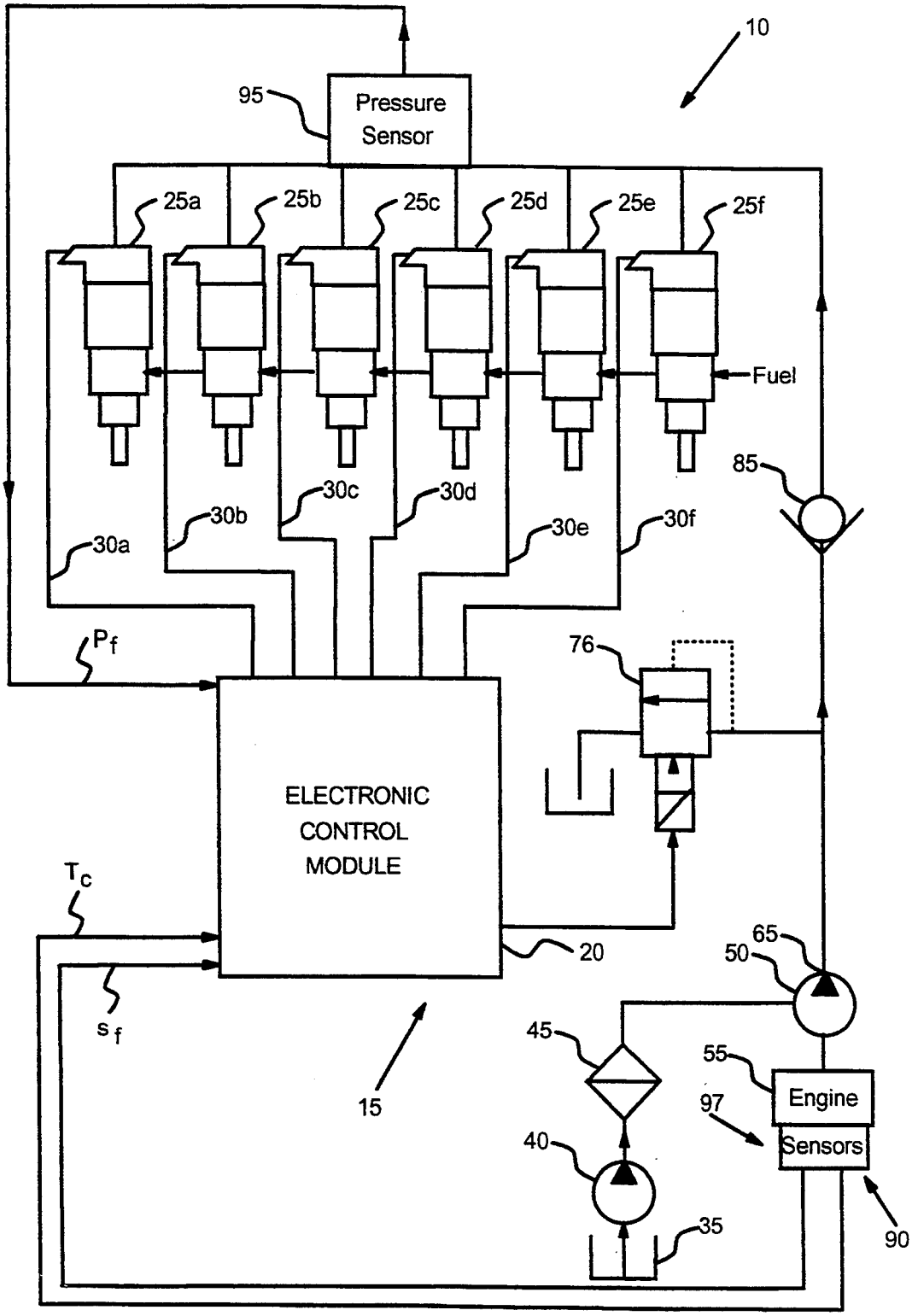
FIG. 1 is a diagrammatic general schematic view of a hydraulically-actuated electronically-controlled injector fuel system for an engine having a plurality of injectors.

Throughout the specification and figures, like reference numerals refer to like components or parts. Referring first to FIG. 1, a preferred embodiment of the electronic control system 10 for a hydraulically actuated electronically controlled unit injector fuel system is shown, hereinafter referred to as the HEUI fuel system. The control system includes an Electronic Control Module 15, hereinafter referred to as the ECM. In the preferred embodiment the ECM is a Motorolla microcontroller, model no. 68HC11. However, many suitable controllers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment the actuating fluid comprises engine oil and the oil supply is the engine oil pan 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 76, hereinafter referred to as the IAPCV. Other devices, which are well known in the art, may be readily and easily substituted for the fixed displacement pump 50 and the IAPCV. For example, one such device includes a variable pressure high displacement pump.

In a preferred embodiment, the IAPCV and the fixed displacement pump 50 permits the ECM to maintain a desired pressure of actuating fluid. A check valve 85 is also provided.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector 25.

The electronic control uses several sensors, some of which are shown. An engine speed sensor 90 reads the signature of a timing wheel applied to the engine camshaft to indicate the engine's rotational position and speed to the ECM. An actuating fluid pressure sensor 95 delivers a signal to the ECM to indicate the actuating fluid pressure. Moreover, an engine coolant temperature sensor 97 delivers a signal to the ECM to indicate engine temperature.

Figure 2:
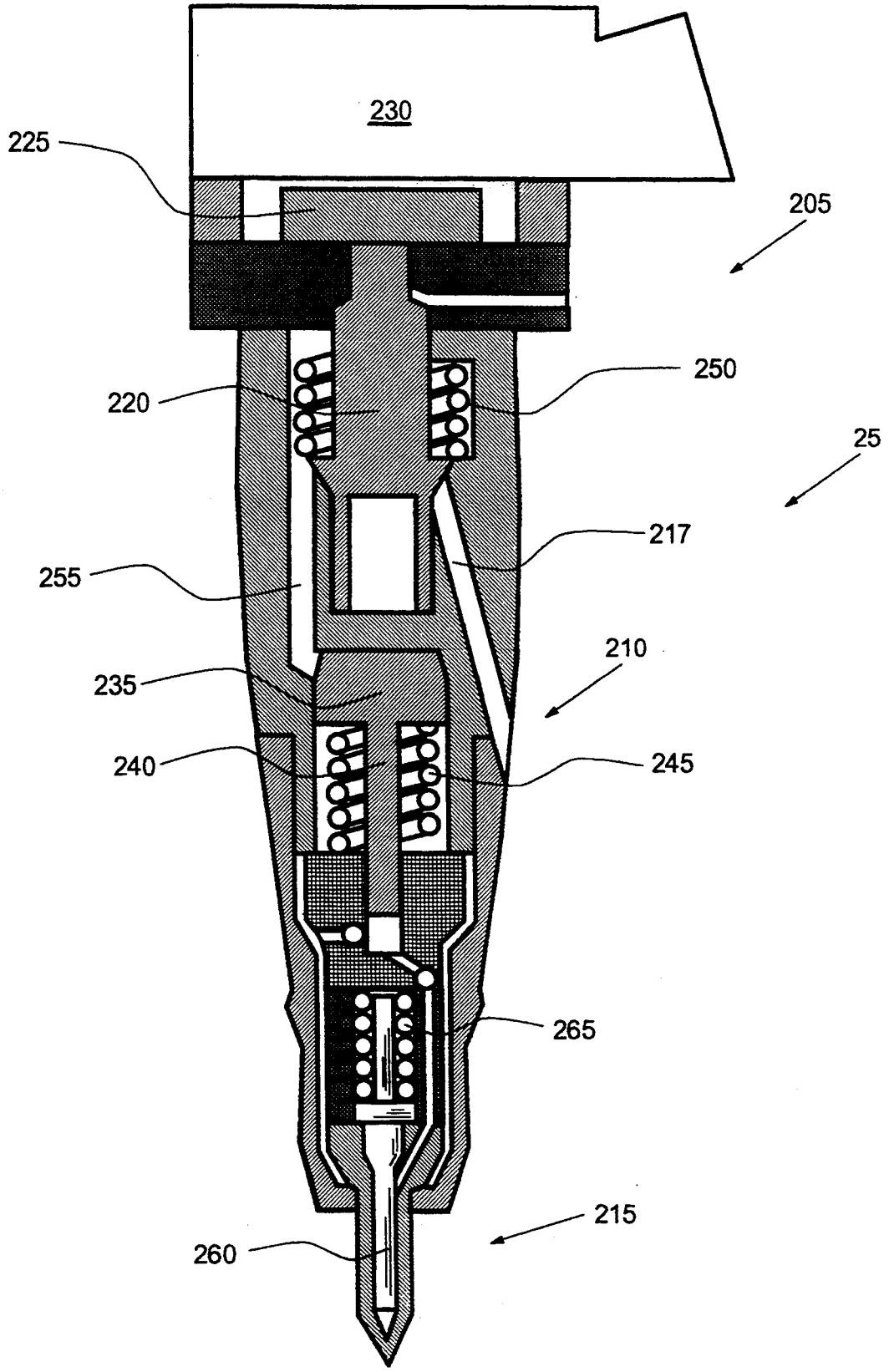
FIG. 2 is a cross sectional view of a hydraulically-actuated electronically-controlled injector for the fuel system of FIG. 1.

The injector operation will now be described with reference to FIG. 2. The injector 25 consists of three main components, a control valve 205, an intensifier 210, and a nozzle 215. The control valve's purpose is to initiate and end, the injection process. The control valve 205 includes a poppet valve 220, armature 225 and solenoid 230. High pressure actuating fluid is supplied to the poppet valve's lower seat via passage 217. To begin injection, the solenoid is energized moving the poppet valve from the lower seat to an upper seat. This action admits high pressure fluid to a spring cavity 250 and to the intensifier 210 via passage 255. Injection continues until the solenoid is de-energized and the poppet moves from the upper to the lower seat. Fluid and fuel pressure decrease as spent fluid is ejected from the injector through the open upper seat to the valve cover area.

The intensifier 210 includes a hydraulic intensifier piston 235, plunger 240, and return spring 245. Intensification of the fuel pressure to desired injection pressure levels is accomplished by the ratio of areas between the intensifier piston 235 and plunger 240. Injection begins as high pressure actuating fluid is supplied to the top of the intensifier piston. As the piston and plunger move downward, the pressure of the fuel below the plunger rises. The piston continues to move downward until the solenoid is de-energized causing the popper 220 to return to the lower seat, blocking fluid flow. The plunger return spring 245 returns the piston and the plunger to their initial positions. As the plunger returns, it draws replenishing fuel into the plunger chamber across a ball check valve.

Fuel is supplied to the nozzle 215 through internal passages. As fuel pressure increases, a needle lifts from a lower seat allowing injection to occur. As pressure decreases at the end of injection, a spring 265 returns the needle to its lower seat.

Because of the physical characteristics of the fuel injector and the actuating fluid flow dynamics, at high actuating fluid viscosities and low actuating fluid pressures, multiple fuel injections may occur during the injection period.

More particularly, as the injector 25 dispenses fuel, the intensifier plunger 240 moves downward, which causes actuating fluid to flow into the control valve cavity 250. However, at high actuating fluid viscosities, actuating fluid flow losses develop, which decreases the actuating fluid pressure in the control valve cavity 250. If the pressure in the control valve cavity 250 drops below a predetermined value, the corresponding drop in fuel injection pressure will cause the needle 260 to close. However, as pressure builds in the control valve cavity, the fuel injection pressure will increase, causing the needle to open and once again dispense fuel. This repeated opening and closing of the needle may continue during the entire injection period causing fuel to be injected in a series of very short bursts. Consequently, multiple injection may provide many beneficial effects including lower emissions, reduced noise, reduced smoke, improved cold starting, white smoke clean-up, and high altitude operation.

The present invention provides for fuel to be injected over a longer period of time than tradition single-pulse injectors. This results in quicker engine starting because the fuel is injected slowly to disperse the fuel throughout the combustion chamber to prevent heat loss at the injection point to aid combustion. Moreover, where multiple injections are produced, the first of the multiple fuel pulses provides an initial flame that supplies heat to ignite the subsequent fuel pulses to quickly cause combustion.

Typically, engine starting includes three engine speed ranges. For example, from 0–200 RPM the engine is said to be cranking (cranking speed range). Once the engine fires, then the engine speed accelerates from engine cranking speeds to engine running speeds (acceleration speed range). Once the engine speed reaches a predetermined engine RPM, e.g. 900 RPM, then the engine is said to be running (running speed range). The present invention is concerned with controlling the fuel injection to start an engine—especially where the engine temperature is below a predetermined temperature, e.g. 18° Celsius.

Figure 5A:
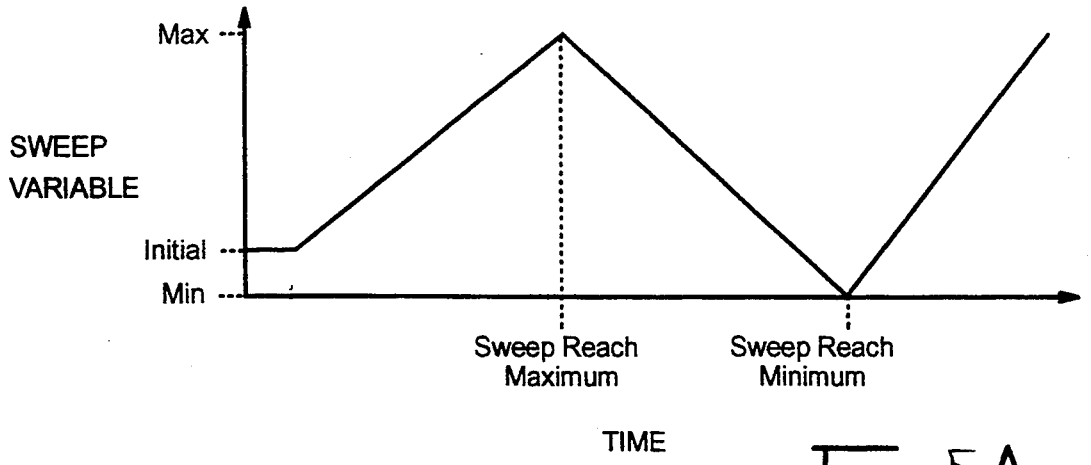
FIGS. 5A–5C are maps utilized in the control strategy of FIGS. 3,4.
Figure 5B:
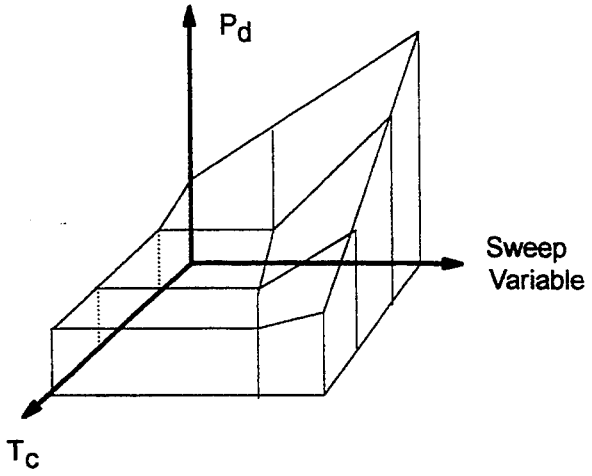
Figure 5C:
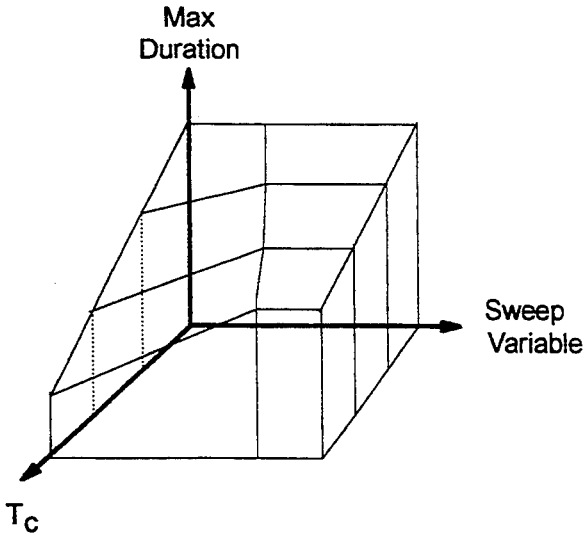

At engine starting conditions while the engine is cranking but not yet firing, the present invention employs a sweeping strategy to determine a desired actuating fluid pressure, and a maximum duration in which fuel is to be injected. A sweep variable is shown in FIG. 5A, while a desired actuating fluid pressure map, and maximum duration map are shown in FIGS. 5B,5C, respectively. Note that the maps in FIGS. 5B,5C are shown for exemplary purposes only.

The operation of the sweep variable is as follows. First, the starting point of the sweep is a predetermined initial value, from which, the sweep variable is swept continuously across a range of minimum and maximum values—until the engine fires. The elapsed time for the sweep variable to sweep from the minimum value to the maximum value and back to the minimum value may be approximately 10 seconds, for example.

The predetermined initial value of the sweep variable may be modified in response to current operating conditions. For example, if the current initial value varies by a predetermined amount from the sweep variable value determined at the time that the engine fired, then the initial value is set to the sweep variable value at firing minus a predetermined amount. Consequently, as the initial sweep direction is upward, the initial value will begin slightly below the optimum sweep variable value.

Note that, the software control determines that the engine has fired by comparing the current engine speed to the engine speed directly sensed before the sweep strategy was started. For example, once the current engine speed reaches a predetermined value, e.g., 100 RPM, above the engine speed sensed before the sweep strategy started; then the engine is said to have fired.

Figure 3:
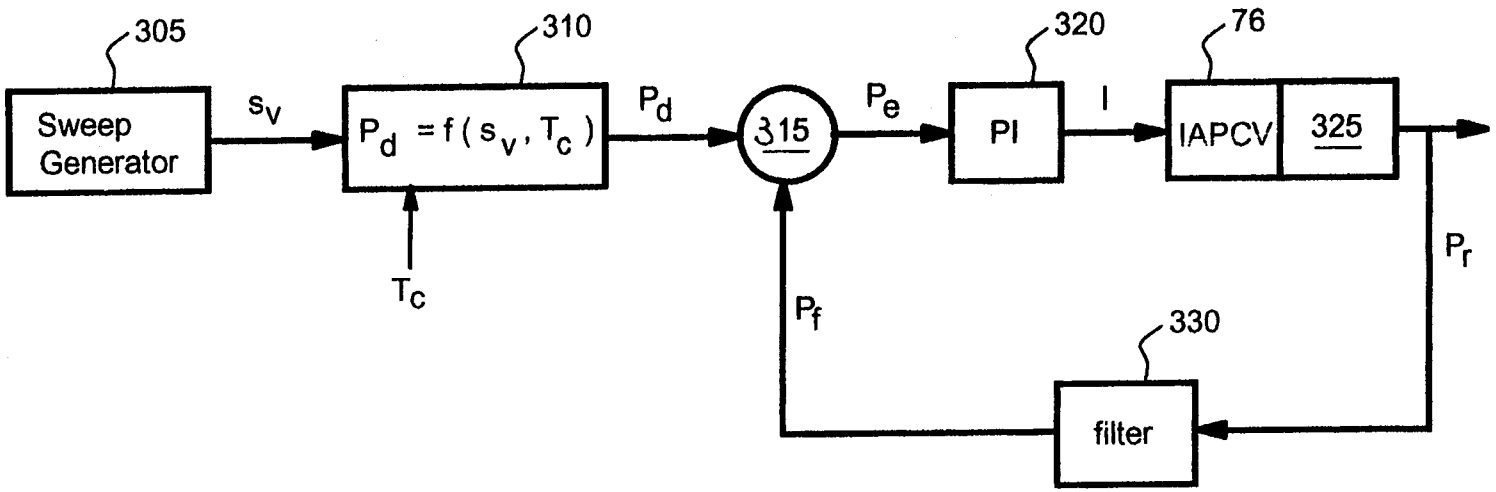
FIG. 3 is a block diagram of an actuating fluid pressure control strategy for the fuel system of FIG. 1, while the engine is cranking, but not yet firing.

The software decision logic for determining the magnitude of the actuating fluid pressure supplied to the injector 25 while the engine is cranking, but not yet firing, is shown with respect to FIG. 3. Preferably, a sweep generator 305 produces a sweep variable signal $S_v$. The sweep variable signal $S_v$, along with an actual engine coolant temperature signal $T_c$ is input into block 310. Note that, the engine coolant temperature is representative of the actuating fluid temperature. Based on the magnitude of the sweeping variable and the coolant temperature, a desired actuating fluid pressure signal $P_d$ is selected as an output. Block 310 may include a map, as shown in FIG. 5B, for example.

The desired actuating fluid pressure signal $P_d$ is then compared by block 315 with an actual actuating fluid pressure signal $P_f$ to produce an actuating fluid pressure error signal $P_e$. This actuating fluid pressure error signal $P_e$ is input to a PI control block 320 whose output is a desired electrical current (I) applied to the IAPCV. By changing the electrical current (I) to the IAPCV the actuating fluid pressure $P_f$ can be increased or decreased. The PI control 320 calculates the electrical current (I) to the IAPCV that would be needed to raise or lower the actuating fluid pressure $P_f$ to result in a zero actuating fluid pressure error signal $P_e$. Note, the loop time for the control may approximately 15 milliseconds, for example. The resulting actuating fluid pressure is used to hydraulically actuate the injector 25. Preferably, the raw actuating fluid pressure signal $P_r$ in the high pressure portion of the actuating fluid pressure circuit 325 is conditioned and converted by a conventional means 330 to eliminate noise and convert the signal to a usable form. Although a PI control is discussed, it will be apparent to those skilled in the art that other controlled strategies may be utilized.

Figure 4:
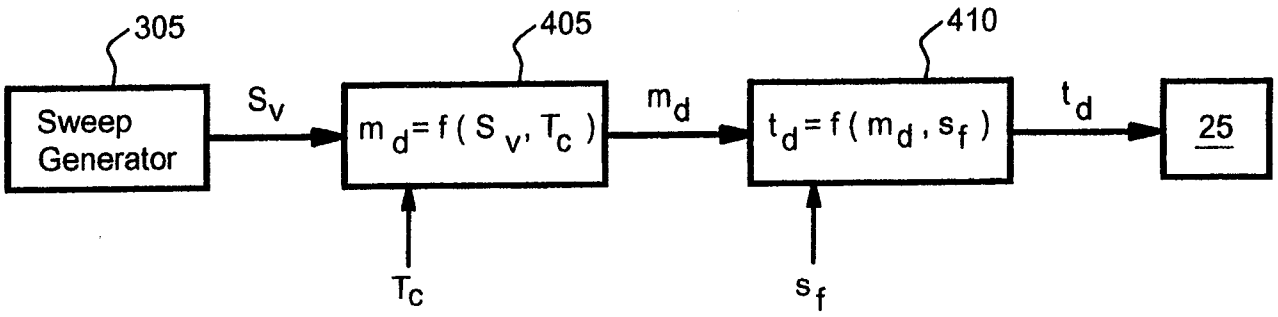
FIG. 4 is a block diagram of a time duration control strategy over which fuel is injected for the fuel system of FIG. 1, while the engine is cranking, but not yet firing.

The software decision logic for determining the time duration or the time window over which fuel is injected by each injector 25 while the engine is cranking, but not yet running, is shown with respect to FIG. 4. Preferably, the sweep variable signal $S_v$, along with an actual engine coolant temperature signal $T_c$ is input into block 405. Block 405 may include a map, as shown in FIG. 5C, for example. Based on the magnitude of the sweeping variable and coolant temperature, a maximum duration signal $m_d$ is selected as an output. The maximum duration signal $m_d$ represents the period, in angular degrees of crankshaft rotation, over which fuel is to be injected.

The maximum duration signal $m_d$, along with an actual engine speed signal is input into block 410, which converts the maximum duration signal $m_d$ into a time duration signal $t_d$ expressed in temporal units, e.g., milliseconds. The time duration signal $t_d$ is used to determine how long the current (I) to the solenoid of a respective injector 25 should remain "on" to inject the correct quantity of fuel.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

The subject invention electronically controls the fuel injection rate and fuel injection duration. More particularly, the present invention is adapted to slow the injection rate, and thus injection quantity, during engine starting by lowering the actuating fluid pressure and injection duration to achieve quicker starting.

In a HEUI fuel system, the injection rate is responsive to the actuating fluid pressure and viscosity. However, because the fluid viscosity is dependant upon the temperature and grade of the fluid, it is difficult to determine a desired actuating fluid pressure that will produce a desired injection rate. Advantageously, the sweep strategy described herein overcomes the difficulty associated with changing fluid viscosity due to an unknown fluid grade.

The present invention sweeps the desired actuating fluid pressure over a predetermined pressure range based on the engine temperature. For example, the pressure ranges from a predetermined minimum pressure, which is the minimum pressure that causes the nozzle needle to lift, to a predetermined maximum pressure, which is the maximum pressure that causes multiple injections. Consequently, the present invention provides for a method of lowering fuel injection quantity by producing multiple injections.

However, because the actuating fluid pressure alone may not completely compensate for lower viscosity fluids (those fluids that may not provide the flow characteristics that result in multiple injections), it may be desirable to reduce the fuel injection duration, while the desired pressure is held at the minimum pressure, in order to reduce the fuel injection quantity. More particularly, when the desired actuating fluid pressure is at the predetermined minimum pressure, the maximum fuel injection duration is then swept over a predetermined duration range based on engine temperature in order to lower the maximum fuel duration value. For example, the maximum duration ranges from a predetermined minimum duration corresponding to a 12 degree rotation of the crankshaft to a predetermined maximum duration corresponding to a 25 degree rotation of the crankshaft.

Thus, the maps shown by FIGS. 5B and 5C, illustrate that only the maximum duration or the desired pressure is changing for a predetermined range of the sweep variable. Thus, while the desired pressure is sweeping over the desired pressure range, the maximum duration will be at the predetermined maximum duration value. However, when the desired pressure is at the minimum pressure value, the maximum duration will be sweeping over the predetermined duration range.

Therefore, the present invention may provide a consistent injection quantity even for the lower viscosity fluids whose flow characteristics result in little actuating fluid pressure losses, thereby causing single injections. Consequently, the desired pressure is held to the minimum pressure value while the maximum injection duration is shortened in order to provide a consistent fuel injection quantity.

Advantageously, the present invention utilizes a sweep strategy to determine the desired actuating pressure and maximum duration combination when the engine fires. Thus, the sweep variable value that resulted in a desired actuating pressure and maximum duration to cause the engine to fire will be used as the predetermined initial value of the sweep variable for future engine starting. Consequently, assuming the fluid grade does not change, the next time that the engine is to be started, the engine should fire very quickly because the sweep variable should result in an optimum combination of desired actuating fluid pressure and maximum duration. If, however, the fluid grade changes from that previously utilized, then the sweep variable will be swept over the sweep range to determine a sweep variable value that will result in a desired actuating pressure and maximum duration that will cause the engine to fire.

Other aspects, objects and advantages of the present invention can be obtained from a study of the drawings, the disclosure and the appended claims.

I claim:

1. A method for controlling a hydraulically-actuated injector (25) to start an internal combustion engine (55), comprising the steps of:

sensing the temperature of the engine and producing a engine temperature signal ($T_c$) indicative of the temperature of actuating fluid used to hydraulically actuate the injector (25);

receiving the temperature signal, and producing a desired actuating fluid pressure signal ($P_d$) whose magnitude oscillates between a pressure range that is a function temperature; and receiving the desired actuating fluid pressure signal ($P_d$), determining a desired electrical current, and producing a desired electrical current signal (I) to control the fuel injection rate.

2. A method, as set forth in claim 1, including the steps of:

sensing an actual actuating fluid pressure and producing an actual actuating fluid pressure signal ($P_f$) indicative of the magnitude of the sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$;$P_f$); and receiving the actuating fluid pressure error signal ($P_e$), determining the desired electrical current based on the actuating fluid pressure error signal ($P_e$), and producing the desired electrical current signal (I).

3. A method, as set forth in claim 2, wherein the desired fluid pressure is determined to cause the fuel injector (25) to produce a plurality of injections during compressive strokes at engine cranking speeds.

4. A method, as set forth in claim 3, including the steps of:

receiving the temperature signal ($T_c$), and producing a maximum duration signal ($m_d$) whose magnitude oscillates between a duration range that is a function temperature, the maximum duration signal indicating the period over which fuel is to be injected; and receiving the maximum duration signal ($m_d$), and delivering an actual time duration signal ($t_d$) to the injector (25) to electronically control the injection period.

* * * * *